United States Patent [19]

Hobson et al.

[11] Patent Number: 5,055,079

[45] Date of Patent: Oct. 8, 1991

[54] COIN BANK WITH SEPARATIONS AND TURNABLE TOP

[76] Inventors: Philip H. Hobson, 800 Clark Blvd., Suite 331, Bramalea, Ontario, Canada, L6T 2E8; Charles E. Goodwin, Apt. 212, 2611 - 1st Avenue N.W., Calgary, Alberta, Canada, T2N 0C5

[21] Appl. No.: 494,934

[22] Filed: Mar. 14, 1990

Related U.S. Application Data

[63] Continuation of Ser. No. 377,793, Jul. 11, 1989, abandoned, which is a continuation of Ser. No. 237,707, Aug. 29, 1988, abandoned.

[51] Int. Cl.[5] ..... A45C 1/12; A63H 29/08; B65D 1/24; B65D 91/00

[52] U.S. Cl. ..... 446/8; 446/168; 220/525; 232/1 D

[58] Field of Search ..... 446/8, 9, 10.11, 12, 446/13, 168, 170, 171, 173

[56] References Cited

U.S. PATENT DOCUMENTS

| | | | |
|---|---|---|---|
| D. 127,448 | 5/1941 | Coller | D99/35 |
| D. 263,089 | 2/1982 | Reaves et al. | D99/34 |
| 2,469,034 | 5/1949 | Garris | 220/22 X |
| 2,903,127 | 9/1959 | Dorman | 220/22 X |
| 2,978,285 | 4/1961 | Jester | 220/22 X |
| 3,630,346 | 12/1971 | Burnside | 206/445 X |
| 3,719,271 | 3/1973 | Authier et al. | 220/22 X |
| 3,720,346 | 3/1973 | Cypher | 220/22.3 |
| 3,782,032 | 1/1974 | Glass et al. | 446/168 X |

FOREIGN PATENT DOCUMENTS

| | | | |
|---|---|---|---|
| 54228 | 7/1900 | Canada . | |
| 43088 | 5/1989 | Canada . | |
| 582495 | 12/1976 | Switzerland | 206/83 |
| 648039 | 12/1950 | United Kingdom | 220/22 |
| 738837 | 10/1955 | United Kingdom | 232/1 D |

*Primary Examiner*—Robert A. Hafer
*Assistant Examiner*—D. Neal Muir
*Attorney, Agent, or Firm*—Arnold, White & Durkee

[57] ABSTRACT

Disclosed is a bank for coins comprising a container having an open top and interior. A cover is rotatably associated with the container top. A plurality of dividers are connected to a support column. The column and dividers are insertable as a unit within the container to divide the interior of the container into a plurality of chambers. The column has an upper end bore and a lower end bore and a collar is associated with the container interior. The column lower end bore and collar are dimensioned to provide an axial interference fit therebetween. There is a pin with a shank end, the shank end and the column upper end bore being dimensioned to provide an axial interference fit therebetween. The cover is rotatable about the pin and is retained in associated with the container by the pin. The pin shank end and the column upper end bore cooperate in such fashion as to limit the interference fit therebetween and to enhance securement of the interference fit between the column lower end bore and the collar.

10 Claims, 3 Drawing Sheets

COIN BANK WITH SEPARATIONS AND TURNABLE TOP

This application is a continuation, of application Ser. No. 377,793, filed July 11, 1989 now abandoned, which is a continuation of 07/237,707 filed Aug. 29, 1988, now abandoned.

Field of the Invention

The invention relates to a bank for coinage and the like and more particularly to a bank which is easily constructed from molded parts and provides various positioned chambers for coins and the like of different denominations.

Background of the Invention

"Piggy" banks are well known to children and adults alike and they are used to teach children to save and used by adults who like to periodically keep loose change for rainy day purchases.

Banks with various slots and/or chambers for different coinage are also known and U.S. Pat. No. 127,448, Mar. 21, 1941 to Coller illustrates such a bank. Similarly U.S. Pat. No. 263,089, Feb. 16, 1982 to Reaves et al shows a collection (coin) receptacle with a rotatable top. Early Canadian Patent 43,088, Feb. 23, 1893 to Colton relates to a toy savings bank which has a rotatable top with a plurality of coinage chambers, the slot in the rotatable top being selectively brought into registry with the slots of the various chambers.

Notwithstanding these early multi-chamber banks with rotatable covers, applicant believes there is still a need for a simple bank which is readily and easily fabricated, preferably of molded parts and which will permit selected advertising on its various parts to be easier imprinted with to-day's high speed multi-color offset printers.

SUMMARY OF THE INVENTION

Accordingly, this invention seeks to provide a coinage and the like bank having a plurality of chambers with slot means associated with a rotatable cover, the construction being such that the bank is easily fabricated with minimal parts, preferably molded, and without the necessity of various special fastener elements.

The invention in one aspect comprehends a bank for coins comprising a container and a cover for rotatable association with the container, the cover having at least one coin receivable slot. At least one divider is provided for dividing the container interior into chambers. The cover is secured to the container for rotatable movement relative thereto and each divider is secured in position within the container.

Preferably the securement for the cover and divider includes a support column for supporting each divider in an appropriate radiant position. This securement includes cooperation between the container interior and the column to secure each divider means in position.

Further, preferably the securement of the cover and divider means further includes a pin, the cover being rotatable about the pin. Cooperation in the form of an interference fit between the pin and the column rotatably secures the cover to the container.

The invention also comprehends a bank for coins comprising a container having an open top and interior and a cover for rotatable association with the container top. There is a support column, and a plurality of dividers are connected to the column with the relative orientation thereof fixed with respect to the column. The column and dividers are insertable as a unit within the container to divide the interior of the container into a plurality of chambers. The column has an upper end bore and a lower end bore and a collar is associated with the container interior, the column lower end bore and collar dimensioned to provide an axial interference fit therebetween. A pin has a shank end which is, along with the column upper end bore, dimensioned to provide an axial interference fit therebetween. The cover is rotatable about the pin and is retained in association with the container by the pin. The pin shank end and the column upper end bore cooperate in such fashion to limit the interference fit therebetween and provide enhanced securement of the interference fit between the column lower end bore and the collar means.

The invention further contemplates a method of assembling a bank for coins wherein the bank comprises a container, a rotatable cover with a coinage aperture therein, and a device for dividing the interior of the container into at least two chambers. The divider device includes a support column having upper and lower ends and the interior of the container has a collar for cooperation with the column lower end to provide securement therebetween. A pin about which the cover may rotate has an end for cooperation with the upper end of the column to provide a rotatable mounting of the cover to the container. The method comprises inserting the divider device into the container, aligning the collar with the lower end of the column, aligning the pin end with the upper end of said column, the cover being rotatably associated with the and causing relative movement between the pin end and the column upper end between the column lower end and the collar, whereby the dividing means and the cover are secured in place in association with the container.

DESCRIPTION OF THE PREFERRED EMBODIMENT

Figure 1:
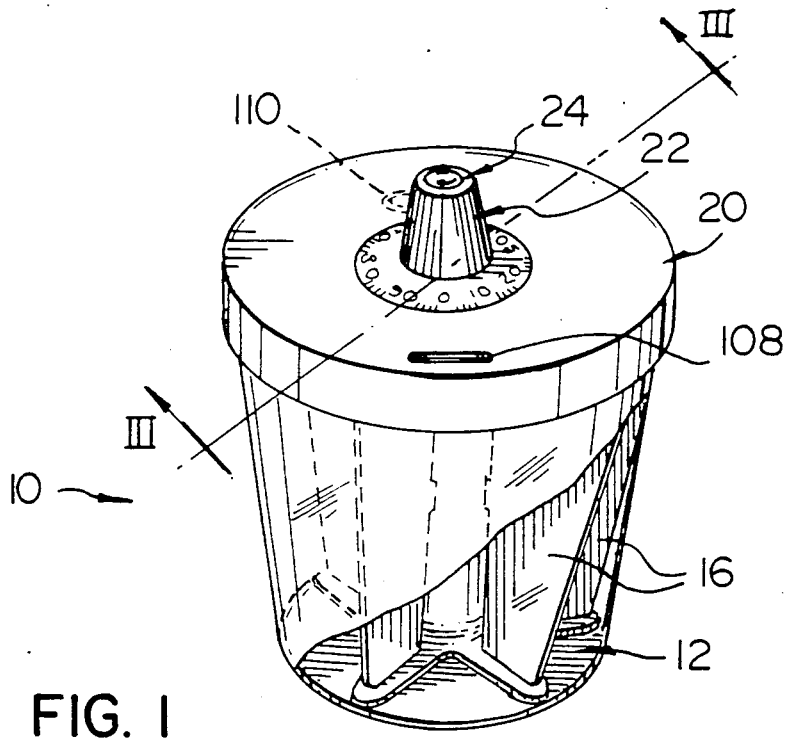
FIG. 1 is a perspective view of the bank of the invention.
Figure 2:
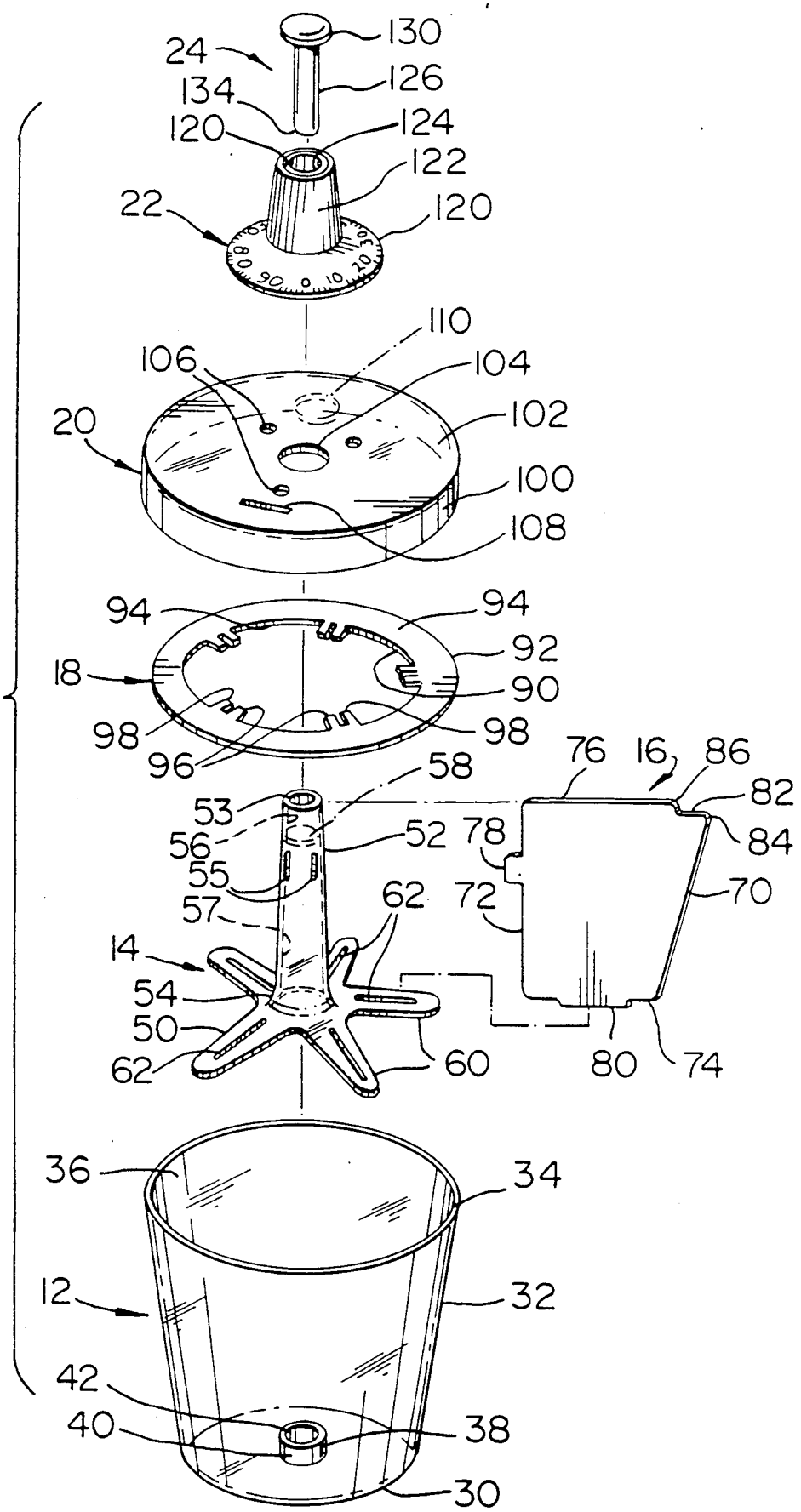
FIG. 2 is an exploded perspective view of the parts making up the novel bank.

Turning to the drawings, the bank 10 as assembled is shown in FIG. 1 whereas the parts of the bank are shown in FIG. 2 in an exploded perspective view and comprise container 12, divider support 14, divider 16 (only one being shown in FIG. 2), lock ring 18, cover 20, knob 22 and pin 24.

Container 12 has an inverted frusto-control shape with bottom 30 and annular wall 32, the upper edge 34 of wall 32 defining an opening 36. Coaxial and integral with bottom 30 and extending upwardly is hollow annular collar 38 having wall 40 and outward chamfered upper edge 42.

Divider support 14 comprises base 50 and integral generally hollow conical column 52 having upper, inwardly chamfered end 53 and lower end 54 adjacent base 50. Column 52 has a plurality of axially directed slots 55 peripherally spaced about column 52. Internal of column 52 and dividing it into two hollow chambers or upper and lower bores 56 and 57 is wall 58 located a predetermined distance down from upper end 53. The internal diameter of lower bore 57 is of predetermined size relative to the outer diameter of collar 38 as will become more apparent herein. The internal diameter of upper bore 56 is of predetermined size pin 24 as will become more apparent herein. Base 50 comprises a plurality (5 being shown) of radiating fingers 60 which provide a starfish design to base 50. Each finger 60 has an elongate through slot 62.

Dividers 16, only one being shown in FIG. 2, are each of trapezoidal shape having outer edge 70, inner edge 72, bottom edge 74 and upper edge 76. Inner edge 72 has a laterally projecting lug 78 sized to fit within slot 55 on column 52. Bottom edge 74 has elongate downwardly projecting lug 80 which is sized to fit within finger slot 62. Upper edge 76 has a recessed shoulder or step 82 adjacent its junction with outer wall 70, step 82 having run portion 84 and rise portion 86. The purpose of step 82 will become more apparent herein.

Lock ring 18 comprises an annular ring having inner end outer peripheral edges 90, 92 respectively and opposed planar sides 94. Extending radially inwardly are projections 96 which each have a slot 98, the width of the slot 98 being substantially the same as the width of divider 16. The width of ring 18 from the bottom of slot 98 to outer edge 92 is substantially the width of run portion 84 of step 82. The thickness of ring 18 is substantially the height of step rise 86.

Figure 3:
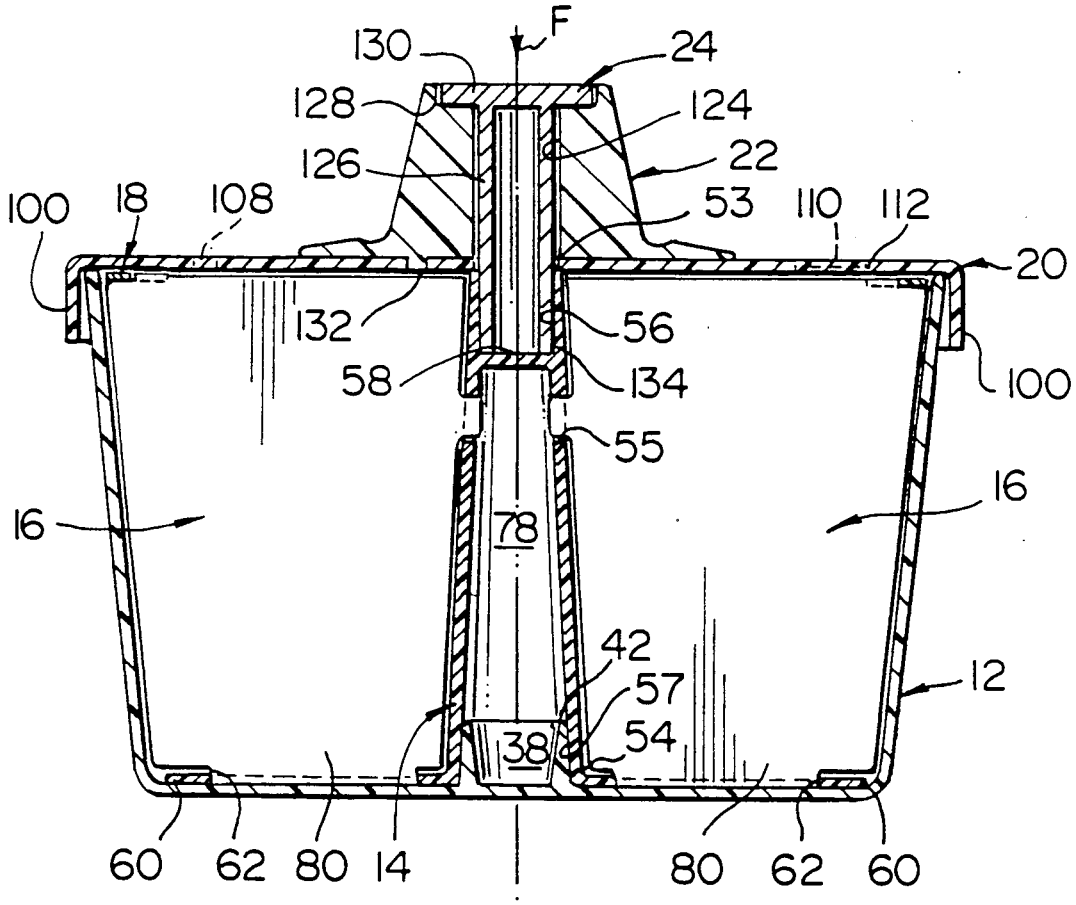
FIG. 3 is a sectional view taken along line 3—3 of FIG. 1.

Cover 20 has peripheral wall 100 with planar top 102, the diametric extent of cover 20 being that wall 100 surrounds the outer wall of container 32 and is in close proximity thereto. Cover 20 has a central aperture 104 with three equally spaced smaller apertures 106. Slot 108 is such that it will accept the largest coin for which the bank is intended, such as a Canadian dollar coin ("Loonie"). Knock out partition or panel 110 is formed in top 102 by elliptical groove 112 formed in the lower surface of top 102 (FIG. 3).

Knob 22 has peripheral flange 120 with coaxial central frustoconical portion 122. Portion 22 has a through aperture 124 adapted to receive the shank 126 of pin 24 and recessed shoulder 128 of portion 122 is adapted to receive head 130 of pin 24. Projecting from the bottom of knob flange 120 are three locating pins or projections 132 (not seen in FIG. 2 but one is shown in FIG. 3) which mate with cover apertures 106.

Central aperture 104 of cover 20 is also adapted to accept shank 126 of pin 24 such that cover 20 is rotatable relative thereto and the length of shank 126 from head 130 to shank end 134 is important relative the location of wall 58 of column 52.

In assembling the bank, each of the parts are molded of appropriate plastic and any printing or the like is applied to container wall 32, divides 16, cover 20 by any means appropriate, the printing being in the nature of advertising material, cartoon characters, scenic views, written material or the like.

The dividers 16 are assembled with support 14 by inserting each divider bottom lug 80 into a slot 62 and lug 78 into a slot 55. Lock ring 18 is then placed over the dividers so that slot 98 is associated with rise 86 of step 82 and the portion of ring 18 radially outwardly of slot 98 sits on step run 84. The dividers are thereby locked into assembly with support 14 by ring 18 and can be inserted into container 12 as a unit.

As best seen in FIG. 3, the diametric relationship of the outer diameter of collar 38 and the inner diameter of lower column bore 57 adjacent base 50 is such that there is an interference fit, with outwardly chamfered edge 42 of collar 38 facilitating the press-fit assembly of column 52 and collar 38. Further, as seen in FIG. 3, the diametric relationship of shank 126 with upper column bore 56 is such that there is an interference fit with inwardly chamfered end 53 facilitating the press fit assembly of pin shank 126 and column 52. Before such assembly however, knob 22 is aligned with cover 20 and assembled with pin 24 so that with the press-fit assembly of pin shank 126 and upper column bore 56, the cover 20 and knob 22 are rotatably held about shank 126. The length of shank 126 and the location of wall 58 is such that when the pin 24, knob 22 and cover 20 are assembled and shank 126 is in press-fit engagement with upper column bore 56, the end 134 of shank 126 contacts wall 58 thereby limiting the axial depth of the press-fit end ensuring that knob 22 and cover 20 are freely rotatable about pin shank 126.

Further, it is important to note that the contact of shank end 134 with wall 58 provides a means for forcing the column 52 with assembled dividers 16 and lock ring 18 down onto collar 38. Accordingly, one downward force F shown in FIG. 3 on head 130 of pin 24 will cause the securement of column 52, with dividers 16 and lock-ring 18 assembled therewith, to collar 38 as well as the rotatable securement of cover 20 and knob 22 about pin 24 and pin 24 to column 52. When cover 20 is rotated, the outer portion of cover 20 adjacent wall 32 rides on the upper edge 34 of container 12 and the inner portion about aperture 104 rides on the tip of chamfered end 53 of column 52.

When assembled, the user may rotate slot 108 in cover 20 by rotating knob 22 to align slot 108 with the selected chamber between two adjacent dividers 16 designated by appropriate markings for the particular coin.

When the bank is substantially full, a sharp tap on knock-out partition or panel 110 will cause the partition to break from cover 110 and permit coins to be removed through the opening left by the removal of the partition or panel 110.

The container 12, lid or cover 20, divider support 14 and divider 16 may be molded of polycarbonate material whereas knob 22 and pin 24 could be of styrene or polypropylene material. If a solid colour or semi-translucent cover is preferred, it can be molded of polypropylene as could the support column and divider. Although retainer or locking ring 18 can be of styrene or polypropylene material, it can also be of relatively stiff cardboard as can be the dividers 16.

Modifications of the bank will be apparent to those skilled in the art.

Figure 4:
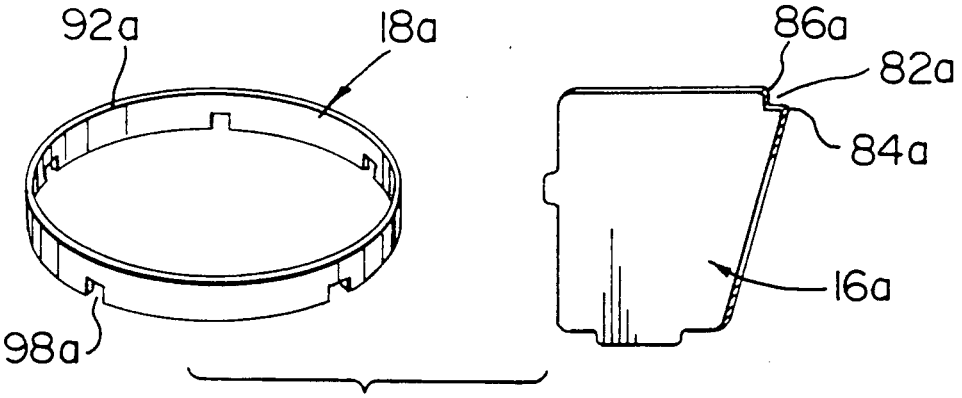
FIG. 4 is a perspective view of a modified locking ring and divider.

By way of example and as shown more particularly in FIG. 4, locking ring **18*a* could extend axially rather than horizontally with shoulder 82*a* having a greater rise 86*a* than run 84*a*. Slots 98*a* in locking ring 18*a* would also have an axial orientation as shown in FIG. 4**.

Figure 5:
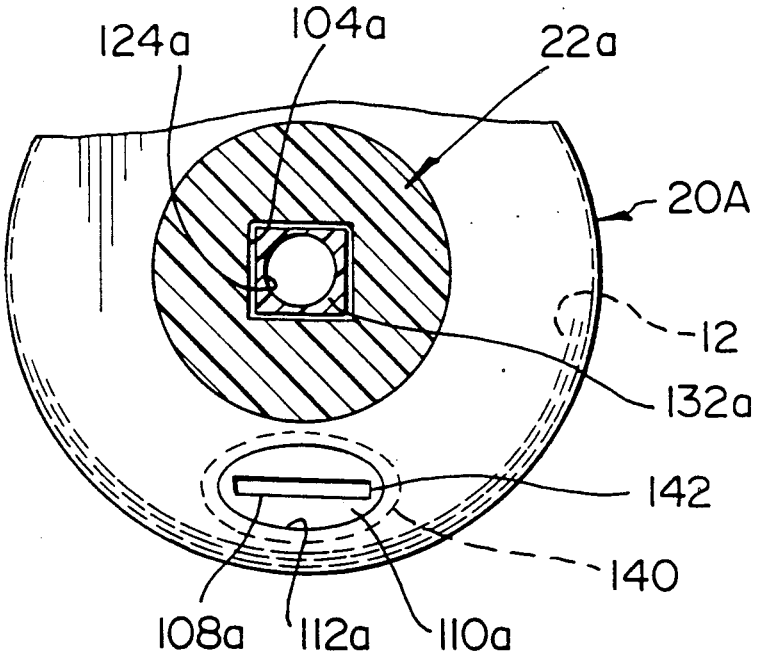
FIG. 5 is a plan view partly in section of a modified knob and cover.

Further, FIG. 5 shows in plan view a modification to the slot 108 and "knock out" panel 110 wherein the slot **108*a* is within the border of the knock out panel 110*a* defined by groove 112*a* as originally molded in cover 20*a*. When the bank is to be "opened", panel 110*a* is "knocked out" or removed and the money in the bank removed. Then a decal 140 having slot 142 substantially the same size as the original slot may be used to cover the opening left by the removal of panel 110***a*. These decals are preferably pressure adhesive decals with a protective backing prior to use, the pressure adhesive being preferably around only the peripheral portion of the decal. A "re-opening" of the bank simply requires the decal 140 to be removed or at least that portion inwardly of the edge of the opening to be cut out. A new decal can then be put in place for re-use of the bank. A further description of the decal is not believed necessary.

It will also be appreciated from FIG. 5 that in place of circular aperture 104 and locating pins 132 with associated apertures 106, a square hole 104*a* in cover 20 cooperating with a square boss 132*a* on the bottom of knob 22 would be effective to provide non-rotatable cooperation between cover 20 and knob 22 and yet permit rotation of the two relative to pin 24 and container 12.

Further, although separate dividers 16 are preferred since it facilitates molding the dividers of a different colour than the colour of support 14, or facilitating printing indicia or affixing decals on to such dividers, panels or dividers 16 could be molded integrally with support 14 in which case locking ring 18 would not be required. However, applicant's unique system of securing the cover and divider means to the container is still applicable.

It should also be appreciated that applicant's have disclosed a sliding interference fit or press fit between support column 52 and collar 38 and between column 52 and pin 126. However, the term "interference" relating to the fit between pin shank end 134 with column upper bore 56 and collar 38 with column lower bore 57 should be construed broadly and by way of example can include a ring/groove snap fit or a bayonet-type connection between the associated parts. A large pitch—one or less revolutions—tight threaded connection could be used wherein rotation of the pin secures the pin to the upper column and when limited by the thread or wall 58, also causes rotation of the support column 52 relative to the container 20.

Although applicant has set forth some modifications to the invention, other modifications within the spirit of the invention will be apparent to those skilled in the art and applicant claims all those which fall within the spirit of the claims appended hereto.

The embodiments of the invention in which an exclusive property of privilege is claimed are defined as follows:

1. A bank for coins, comprising:

container means having an open top and interior;

cover means for rotatable association with the top of the container means, said cover means having at least one coin receivable aperture;

at least one divider means for dividing the container interior into chambers;

securement means for securing the cover to the container for rotatable movement relative thereto and for securing each said divider means in position within said container;

said securement means including a support column within said container for supporting each divider means in an appropriate angular position, and first means cooperating between said container interior and said column securing each said divider means in said angular position;

said securement means further including pin means, said cover being rotatable about said pin means; and second means cooperating between said pin means and said support column rotatably securing said cover to said container;

said support column having a lower end and said first cooperating means including collar means extending upwardly and centrally from the container interior, a bore in the lower end of said support column; and said collar and lower end bore being respectively dimensioned for an interference fit.

2. The bank according to claim 1 wherein said cover includes a "knock-out" panel whereby the bank may be selectively opened to remove coins and the like through the hold left by removing said panel.

3. The bank according to claim 2 wherein the coin receivable aperture is within and through said knock-out panel, said hole being closeable with a decal having a coin receivable aperture therethrough.

4. A bank for coins comprising:

container means having an open top and interior;

cover means for rotatable association with the top of the container means, said cover means having at least one coin receivable aperture;

at least one divider means for dividing the container interior into chambers;

securement means for securing the cover to the container for rotatable movement relative thereto and for securing each said divider means in position within said container;

said securement means including a support column within said container for supporting each divider means in an appropriate angular position, and first means cooperating between said container interior and said column securing each said divider means in said angular position;

said securement means further including pin means, said cover being rotatable about said pin means; and second means cooperating between said pin means and said support column rotatably securing said cover to said container;

said support column having an upper end and said second cooperating means including a shank on said pin means and a bore in the upper end of said column, said shank and upper end bore being respectively dimensioned for an interference fit, said cover having an opening therein through which said shank passes to permit rotation of said cover thereabout;

said support column having a wall spaced a predetermined distance from said column upper end, said pin shank having a lower end which cooperates with said wall to limit the depth of interference fit of said second cooperating means; and said support column having a lower end and said first cooperating means including collar means extending upwardly and centrally from the container interior, a bore in the lower end of said support column; and said collar and lower end bore being respectively dimensioned for an interference fit.

5. The bank according to claim 4 wherein said cover includes a "knock-out" panel whereby the bank may be selectively opened to remove coins through the hole left by removing said panel.

6. The bank according to claim 5 wherein the coin receivable aperture is through said knock-out panel, said hole being closeable with a decal having a coin receivable aperture therethrough.

7. A method of assembling a bank for coins wherein the bank comprises container, a rotatable cover with a coinage aperture therein, and means for dividing the interior of the container into at least two chambers, said dividing means including a plurality of individual dividers and a support column having upper and lower ends, said interior of the container having first means for cooperating with said column lower end to provide securement therebetween, and pin means about which said cover may rotate having second means for cooperation with the upper end of said column to provide a rotatable mounting of said cover to said container, said method comprising the steps of:

assembling said dividers to said support column to provide said dividing means;

inserting said dividing means into said container;

aligning said first means with the lower end of said column;

aligning said second means with the upper end of said column, said cover being rotatably associated with said pin means, and causing relative movement between said second means and said column upper end and between said column lower end and said first means, whereby said dividing means and cover are secured in place in association with said container.

8. The method according to claim 7 wherein said first means comprises a collar means extending upwardly and centrally from the container interior and said second means comprises a lower end of said pin means, said column end including lower end and upper end bores for respective interference association with said collar means and said pin means lower end.

9. The method according to claim 8 wherein said interference association is by way of a pressfit and the relative movement is substantially axial.

10. The method according to claim 9 wherein said column includes wall means intermediate said upper bore and lower bore whereby cooperation of the lower end of said pin means with said wall means limits axial movement of said pin means relative to the upper end of said column and enhances positive axial movement and interference fit between the column lower end bore and said collar means.

* * * * *

UNITED STATES PATENT AND TRADEMARK OFFICE

CERTIFICATE OF CORRECTION

PATENT NO. : 5,055,079

DATED : OCTOBER 8, 1991

INVENTOR(S) : PHILIP H. HOBSON AND CHARLES E. GOODWIN

It is certified that error appears in the above-identified patent and that said Letters Patent is hereby corrected as shown below:

On the title page under the Abstract, line 15, "associated" should read --association--.

In column 1, line 23, after "U.S.", please insert --Design--.

In column 1, line 25, after "U.S.", please insert --Design--.

In column 3, line 8, after "size", please insert --relative--.

In column 3, line 25, "end" should read --and--.

Signed and Sealed this

Thirtieth Day of March, 1993

*Attest:*

STEPHEN G. KUNIN

*Attesting Officer*

*Acting Commissioner of Patents and Trademarks*